US006325256B1

(12) United States Patent
Liljeqvist et al.

(10) Patent No.: US 6,325,256 B1
(45) Date of Patent: Dec. 4, 2001

(54) AEROSOL CONTAINER FOR FLOWABLE ADHESIVES WITH ADAPTERS TO AVOID CLOGGING OF THE AEROSOL CONTAINER

(75) Inventors: Lance Liljeqvist, Wilton; Edward Kozlowski, Uncasville, both of CT (US)

(73) Assignee: The Glidden Company, Cleveland, OH (US)

( * ) Notice: Subject to any disclaimer, the term of this patent is extended or adjusted under 35 U.S.C. 154(b) by 0 days.

(21) Appl. No.: 09/697,950

(22) Filed: Jan. 12, 2001

(51) Int. Cl.[7] ..... B67D 1/08; B65D 83/14; B65D 83/18

(52) U.S. Cl. ..... 222/402.15; 222/151; 222/546; 222/402.13; 239/123

(58) Field of Search ..... 222/342, 148, 222/345, 575, 149, 151, 563, 402.13, 402.15, 546; 239/104, 106, 114, 115, 116, 117, 123

(56) References Cited

U.S. PATENT DOCUMENTS 4,146,152 * 3/1979 Ogawa et al. ..... 222/81
4,408,699 * 10/1983 Stock ..... 222/149
5,154,327 * 10/1992 Long ..... 222/326
5,379,927 * 1/1995 Montenieri et al. ..... 222/546
5,549,226 * 8/1996 Kopp ..... 222/402.13
6,000,633 * 12/1999 Lund et al. ..... 239/211

* cited by examiner

*Primary Examiner*—Kevin Shaver
*Assistant Examiner*—Stephanie L. Willatt
(74) *Attorney, Agent, or Firm*—Thomas M. Schmitz

(57) ABSTRACT

An aerosol container for dispensing adhesives under pressure is retrofitted with an adapter means for preventing clogging of the discharge valve with old adhesive after use. The adapter means comprises an interior sleeve inserted within an exterior dispensing tip where the assembly is retrofitted into the discharge valve of the aerosol container. A trigger mechanism attached to the top of the aerosol container engages the aerosol can discharge valve to facilitate bias engagement of the discharge valve of the aerosol container.

6 Claims, 3 Drawing Sheets

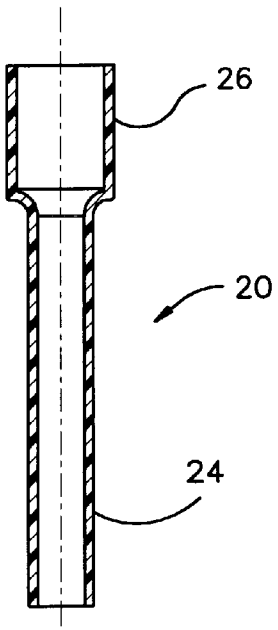
Fig.8
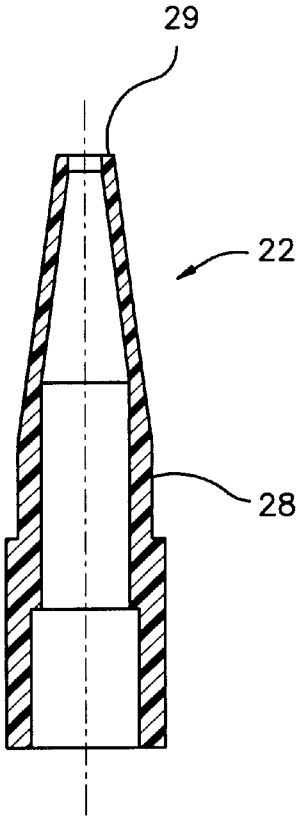
Fig.7
Fig.5
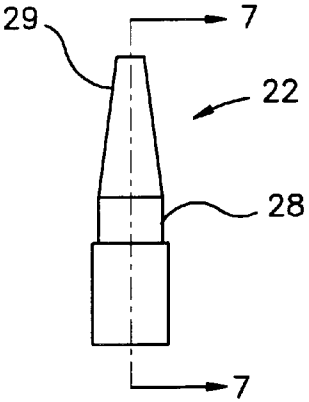
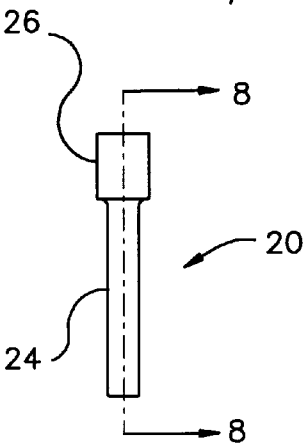
Fig.6
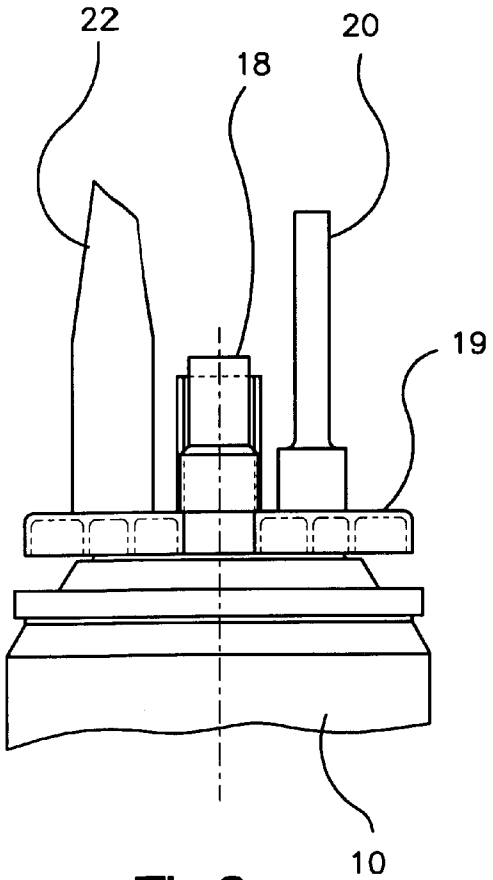
Fig.3

AEROSOL CONTAINER FOR FLOWABLE ADHESIVES WITH ADAPTERS TO AVOID CLOGGING OF THE AEROSOL CONTAINER

This invention pertains to aerosol adhesive containers and more particularly to an adapter means in combination with the aerosol container to enable multiple subsequent use of the aerosol adhesive container and overcome adhesive clogging in the container aerosol discharge valve.

BACKGROUND OF THE INVENTION

Fluid adhesives are marketed in aerosol containers pressurized with propellant self contained within the container. In use, adhesive under pressure emerges from the discharge valve directed toward the substrate to be adhered. By the nature of adhesive materials, ordinarily sticky and often viscous, the discharge valve frequently becomes plugged and otherwise difficult to use due to dried old adhesive material collecting and hardening inside and around discharge valve after use. Considerable effort must be exerted to dislodge the blocking adhesive, while sometimes the aerosol container must be discarded if the plugging becomes extensive. In essence, adhesive blocking in the container discharge valve after each use is a nuisance to the consumer and structural changes are necessary to prevent or overcome the blocking.

It now has been found that conventional aerosol container valves can be retrofitted with throw away plastic adapters which avoid adhesive plugging after each use of the adhesive container. The adapters are inserted into the discharge valve or nozzle of the aerosol container prior to use. The adapter means is maintained in place or may be removed after the adhesive is used to assure that the discharge nozzle is maintained open and unplugged and to prevent subsequent plugging and hardening of the adhesive in the container discharge valve. If the plastic adapter means of this invention becomes plugged after one or more uses, the adapter can be discarded and replaced with a new adapter means to once again maintain the container nozzle free of plugging adhesive. Meanwhile, the original container valve remains free of plugging by hardened adhesives. The plastic adapters are cheap and easy to manufacture, simple to use by merely inserting into the container discharge valve, and can be packaged with the aerosol container for easy access. In a preferred aspect of the invention, a plastic ring can be attached to the top of the aerosol container for holding adapters which can be expediently removed from the ring to replace the previous adapter means as needed. In preferred aspects of the invention, a hand activated trigger mechanism is attached to the aerosol container where the trigger mechanism contains a central opening to accommodate the container discharge valve and the adapting means of this invention. The trigger mechanism provides biased pressure on the discharge valve to facilitate dispensing of the adhesive from the aerosol container through the container discharge valve. These and other advantages of the invention will become more apparent by referring to the drawings and the detailed description of the invention.

SUMMARY OF THE INVENTION

Briefly, the invention pertains to an adapter means in combination with an aerosol container for discharging adhesives where the adapter means can be connected to an existing aerosol adhesive container having a discharge valve or nozzle. The adapter means comprises an interior sleeve insert in combination with an exterior dispensing tip for fitting within and engaging the existing discharge valve to prevent clogging of the discharge valve with adhesive after use. In a preferred aspect of the invention, a trigger mechanism is attached to, or otherwise locked onto the top of the aerosol container, where the trigger mechanism contains a central opening for accommodating the discharge valve protruding through the central opening along with the insert sleeve and exterior dispensing tip. The trigger mechanism is operative to bias the discharge valve along with the interior sleeve and exterior dispensing tip to activate discharging adhesive from the aerosol container in use.

IN THE DRAWINGS

FIG. 3 is an enlarged partial front elevation view of the upper adhesive container with the trigger mechanism removed;

FIG. 5 is a front elevation view of the dispensing tip of the adapter means in FIG. 1;

FIG. 6 is a front elevation of the internal sleeve insert of the adapter means in FIG. 1;

FIG. 7 is an enlarged elevation sectional view of the dispensing tip taken along lines 7—7 in FIG. 5;

FIG. 8 is an enlarged elevation sectional view of the internal sleeve insert taken along lines 8—8 in FIG. 6;

DETAILED DESCRIPTION OF THE INVENTION

Figure 4:
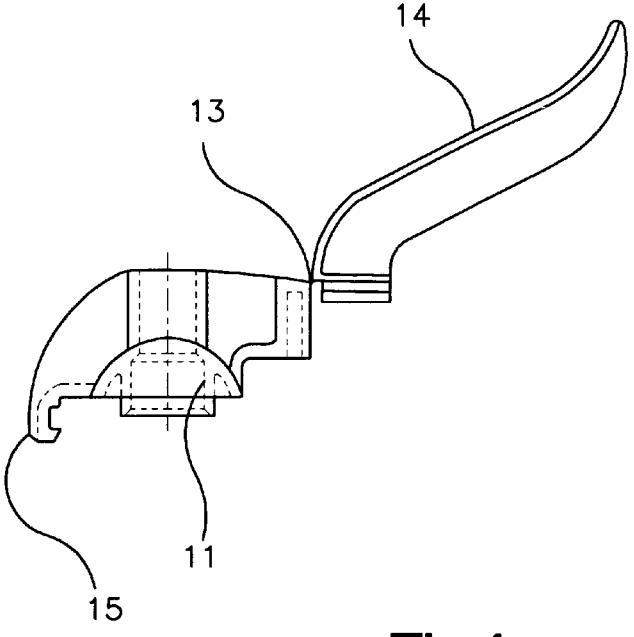
FIG. 4 is an enlarged front elevation view of the trigger mechanism removed from the adhesive container in FIG. 1.
Figure 2:
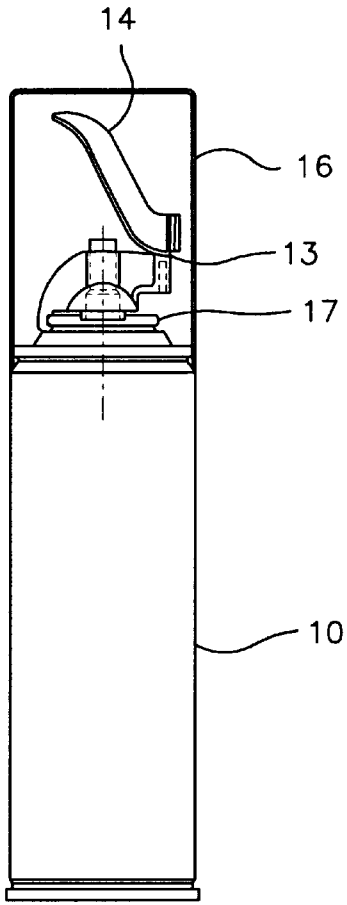
FIG. 2 is a front elevation view similar to FIG. 1 but with the trigger handle rotated upwardly while disposed within a hollow cap for the adhesive container.

Referring now to the drawings wherein like reference character indicate like parts, shown generally is an aerosol container 10 for dispensing adhesives under pressure for application to substrates to be adhered together. The container 10 has a trigger mechanism 12 secured to the top end of the can 10 for providing bias engagement with the discharge mechanism of the container 10 and to facilitate discharge of the adhesive. The trigger mechanism 12 includes a central opening 11 for receiving the upwardly extending discharge valve 18 which in turn receives the adapter means of this invention. The adapter means comprises a dispensing tip 22 and a depending sleeve insert 20 adapted to be retrofitted into the discharge valve 18 of the aerosol can 10. The trigger mechanism 12 includes a hinge 13 connected to trigger handle 14 adapted to rotate the handle 14 upwardly and reversely to enable the entire handle mechanism 12 to fit within a hollow removable top 16 attached to the top of aerosol container 10 when not in use, as shown in FIG. 2. The reversely rotated handle 14 becomes vertically aligned within the outermost circular periphery of the exterior of the container to provide full containment of the rotated mechanism within the cap 16 attached to the container 10. The trigger mechanism 12 has a forward clip point 15 for tightly engaging a top circular peripheral lip ring 17 surrounding the discharge valve 18 and located radially inward and at the uppermost top of the aerosol container 10.

Figure 1:
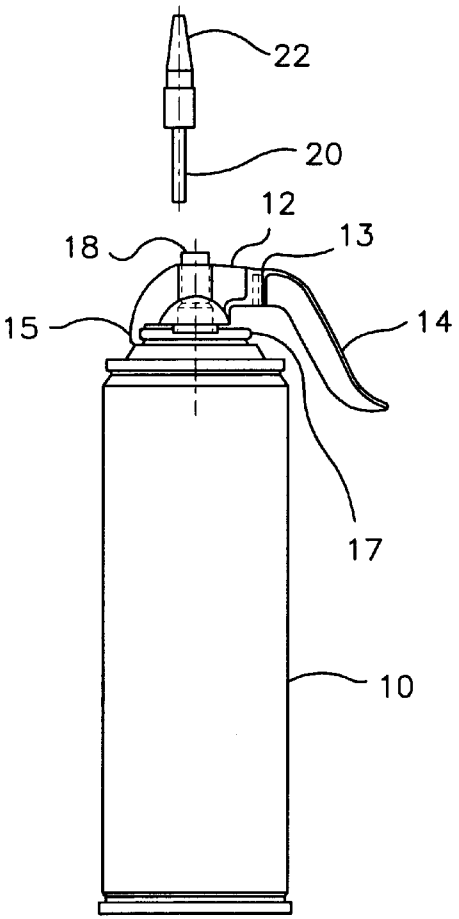
FIG. 1 is a front elevation view of an aerosol adhesive container with a trigger mechanism for activating the discharge valve for dispensing adhesive from the container and showing the adapter means of this invention above the trigger mechanism.

In accordance with this invention, the container 10 can be retrofitted with an adapter means comprising the tubular internal sleeve insert 20 shown in FIG. 6 and the external tubular dispensing tip 22 shown in FIG. 5, where the sleeve insert 20 slip fits within the dispensing tip 22 in use as shown in FIG. 1. The discharge valve 18 is a spring biased cylindrical hollow tube extending upwardly and operative to expel adhesive from the container under pressure by applying a biased force to the side of the upwardly extending tube. The sleeve insert 20 has a lower extended hollow narrow tube 24 adapted to be inserted within the discharge valve 18 of a conventional aerosol container 10. The sleeve insert 20 has an upper enlarged hollow neck 26 for fitting within and engaging the midsection 28 of the dispensing tip 22, while the lower tube 24 end is inserted within the discharge valve 18 of the container 10. In use, the interior sleeve insert 20 can be slip fitted within the dispensing tip 22, which together can be inserted by the tube end 24 into the discharge nozzle 18 of the aerosol container 10. Alternatively, the sleeve insert 20 and dispensing tip 28 combination can be inserted into the valve 18 after the trigger mechanism 12 is already attached to the aerosol container 10 with the container discharge valve 18 extending upwardly through opening 11 provided in the trigger mechanism 12.

Figure 9:
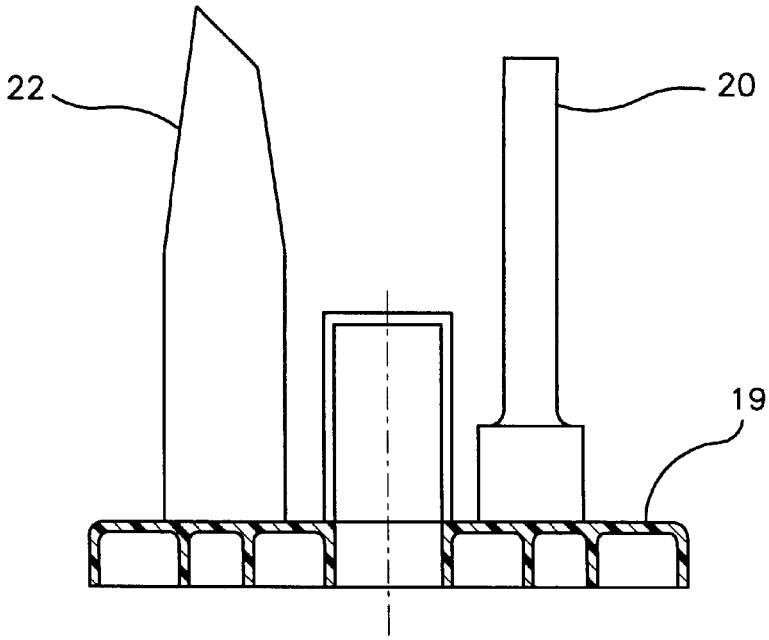
FIG. 9 is an enlarged elevation sectional view taken along lines 9—9 in FIG. 10 of the adapter means shown supported by a plastic ring in the manner shown in FIG. 3.
Figure 10:
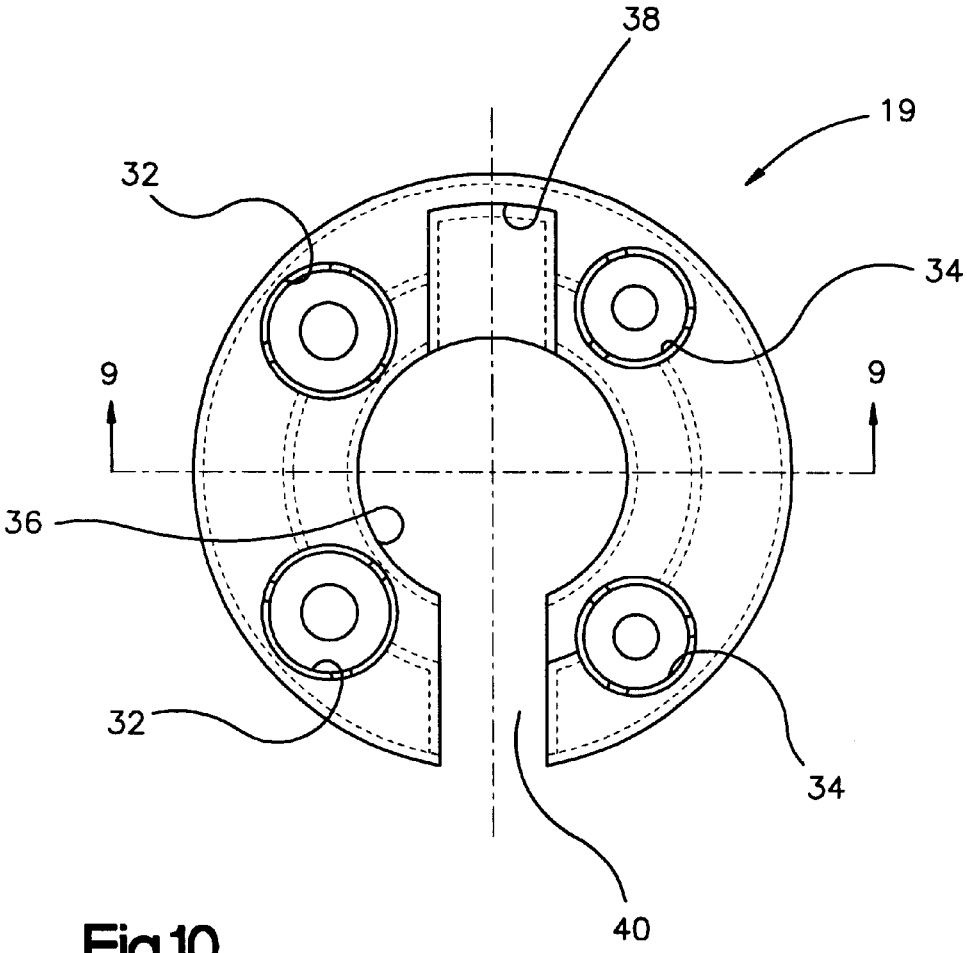
FIG. 10 is a bottom plan view of the bottom of the plastic ring shown in FIG. 9.

In FIG. 3, the top end of an aerosol container 10 is shown with the discharge valve 18 of the aerosol container 10 along with plastic holder ring 19 supporting upright the sleeve insert 20 and dispensing tip 22 prior to retrofitting into the existing container discharge valve 18. Similar to FIG. 3, shown in FIG. 9 is a vertical section view along lines 9—9 in FIG. 10 of the upper ring holder 19 shown in FIG. 3 and supporting the discharge tip 22 and the sleeve insert 20 prior to use by attachment to the existing discharge valve 18 of the aerosol container 10. FIG. 10 is a full bottom view of the plastic ring holder 19 shown in FIG. 9 where the ring holder 19 contains four, but can contain up to six, radially orientated circumferentially spaced circular openings with openings disposed on either side of the ring holder 19. The openings 32 on the left side accommodate and provide support for two or three dispensing tips 22, while the openings 34 on the right side accommodate and provide support for two or three sleeve inserts 20 prior to use in a manner shown in FIG. 3. The plastic ring holder 19 comprises a discontinuous circular ring having an internal central opening 36 adapted to accommodate the trigger mechanism 12 and discharge valve 18 protruding through the central opening 36. The discontinuous circular ring 19 contains a space or discontinuity defined by an arcuate opening 40 in the circumference of the ring to accommodate the trigger handle 14 in use. The arcuate opening 40 is diametrically opposite to a notched opening 38 in the circular ring 19 to accommodate the forward clip point 15 of the trigger mechanism 12 engaging the uppermost round lip 17 of the aerosol container 10. The plastic ring holder 19 conveniently supports replacement dispersing tips 22 and sleeve inserts 20 during shipping and subsequent uses.

The aerosol container 10 is a sealed aerosol can pressurized with liquefied or compressed gas to discharge the contents of the aerosol can under pressure. In this invention, the contents of the aerosol container is fluid adhesive and typically somewhat viscous adhesive. The adhesive is discharged under pressure by applying bias pressure on the small cylindrical tubular valve 18 thereby activating pressurized discharge of the adhesive through the discharge valve 18. Ordinarily the discharge valve 18 is spring biased and contains a depending stem for activating flow of the adhesive through the tubular valve 18 under pressure. The hand trigger mechanism facilitates the application of bias force to the discharge valve 18.

In accordance with this invention, the aerosol adhesive container 10 ordinarily will be purchased by the consumer as a self contained unit, as shown in FIG. 2, but also may contain a plastic ring 19 attached to the top of the container for supporting extra dispensing tips 22 and sleeve inserts 20. A sleeve insert 20 and a dispensing tip 22 can be removed from the plastic ring 19, assembled together and inserted through the trigger mechanism 12 to engage the upwardly extending discharge valve 18. The aerosol container 10 can be oriented for use while adhesive is discharged through the dispensing tip 22. After the adhesive application is completed, the aerosol container 10 can be stored upright after use with the sleeve insert 20 and dispensing tip 22 remaining in place within the discharge valve 18 on the container 10. Alternatively, the insert 20 and discharge tip 22 can be removed after use. If the insert sleeve 20 and discharge tip 22 assembly becomes plugged with hardened adhesive after use, the first sleeve insert and discharge tip assemble can be removed and replaced with a second sleeve insert and discharge tip assembly.

The scope of the invention is not intended to be limited to the detailed description and the illustrative drawings contained herein but only by the appended claims.

What is claimed is:

1. In combination with an aerosol pressurized can of adhesive having a top peripheral lip surrounding an upwardly extending tubular discharge valve for discharging adhesive from the aerosol can under pressure, comprising:

a removable adapter means combination of an interior tubular sleeve insert and a removable exterior tubular dispensing tip where the sleeve insert is inserted into the discharge valve and the dispensing tip is slip fitted over the sleeve insert, where the adapter means combination prevents adhesive from clogging in the discharge valve after use of the aerosol can of adhesive, and the adapter means combination is removable from the discharge valve for replacement by a second adapter means combination.

2. The aerosol can of adhesive in combination with the adapter means combination in claim 1 having a hand activated trigger mechanism engaging the discharge valve of the aerosol can and attached to the top peripheral lip surrounding the discharge valve of the aerosol can, the trigger mechanism having a central opening surrounding the upwardly extending aerosol discharge valve protruding through the central opening, the trigger mechanism having a rearward handle operative to provide a bias force against the discharge valve to activate the discharge of adhesive from the aerosol can and a forward clip secured to the top peripheral lip of the aerosol can.

3. The aerosol can of adhesive combination in claim 2 where the trigger mechanism includes a handle having a hinged connection to enable the handle to rotate upwardly and reversely toward the forward clip to become vertically aligned within the outermost peripheral profile of the aerosol can.

4. The aerosol can of adhesive combination in claim 3 where a removable hollow top cap is fitted over and encloses the vertically aligned trigger mechanism with the handle rotated upwardly to provide a self contained aerosol container.

5. The aerosol can of adhesive combination in claim 1 having a removal plastic ring engaging the uppermost circular lip surrounding the discharge valve, where the plastic ring handle has supporting means for supporting upright a second set of adapter means consisting of a second sleeve insert and a second dispensing tip.

6. The aerosol can of adhesive combination of claim 5 where the plastic ring contains a third set of adapter means.

* * * * *